US006836985B2

(12) United States Patent
Mathew

(10) Patent No.: US 6,836,985 B2
(45) Date of Patent: Jan. 4, 2005

(54) SOLAR POWERED DISPLAY

(76) Inventor: Brian Mathew, 930 Route 9H, Ghent, NY (US) 12075

( * ) Notice: Subject to any disclaimer, the term of this patent is extended or adjusted under 35 U.S.C. 154(b) by 0 days.

(21) Appl. No.: 10/443,255

(22) Filed: May 22, 2003

(65) Prior Publication Data

US 2004/0231210 A1 Nov. 25, 2004

(51) Int. Cl.[7] ..... G09F 19/00; G09F 19/02
(52) U.S. Cl. ..... 40/430; 40/473; 40/423
(58) Field of Search ..... 40/473, 411, 421, 40/423, 414, 430

(56) References Cited

U.S. PATENT DOCUMENTS

| | | | | | |
|---|---|---|---|---|---|
| 1,015,714 | A | * | 1/1912 | Samuels | 40/445 |
| 1,375,261 | A | * | 4/1921 | Rasmussen, Sr. et al. | 40/421 |
| 1,525,746 | A | * | 2/1925 | Kennedy | 40/439 |
| 1,538,178 | A | * | 5/1925 | Deighan | 40/438 |
| 2,110,646 | A | | 3/1938 | Currie | 40/138 |
| 2,126,567 | A | | 8/1938 | McCallum | 40/37 |
| 2,405,376 | A | * | 8/1946 | Stubbins | 40/472 |
| 4,702,140 | A | | 10/1987 | Goldfarb | 84/1.01 |
| 4,942,723 | A | | 7/1990 | Wassell | 56/10.6 |
| 4,970,814 | A | | 11/1990 | Briscoe | 40/511 |
| 4,989,124 | A | | 1/1991 | Shappell | 362/183 |
| 5,016,145 | A | | 5/1991 | Singleton | 362/80.1 |
| 5,109,989 | A | | 5/1992 | Kremmin et al. | 211/1.55 |
| 5,237,764 | A | * | 8/1993 | Gray | 40/473 |
| 5,315,492 | A | | 5/1994 | Davenport | 362/122 |
| 5,396,408 | A | | 3/1995 | Szczech, III | 362/397 |
| 5,518,784 | A | | 5/1996 | Fussell | 428/7 |
| 5,886,954 | A | | 3/1999 | Asami et al. | 368/67 |
| 6,175,342 | B1 | | 1/2001 | Nicholson et al. | 345/1 |
| 6,250,798 | B1 | | 6/2001 | Brainard et al. | 368/180 |
| 6,414,650 | B1 | | 7/2002 | Nicholson et al. | 345/1.1 |
| 6,428,382 | B1 | | 8/2002 | Randolph | 446/149 |
| 6,446,375 | B1 | | 9/2002 | Davis | 40/597 |
| 6,502,338 | B1 | | 1/2003 | Marshall | 40/430 |
| 6,524,073 | B2 | | 2/2003 | Mnatsakanian | 416/223 |
| 2003/0121190 | A1 | * | 7/2003 | Spivak | 40/411 |

* cited by examiner

*Primary Examiner*—Cassandra Davis
(74) *Attorney, Agent, or Firm*—Heslin Rothenberg Farley & Mesiti P.C.

(57) ABSTRACT

A solar powered window ornament including one or more photovoltaic cells used to power a drive mechanism that rotates at least one wheel for a vehicle body. The vehicle body is removable attached to a frame adapted to secure to a window. The vehicle body may be selected from a variety of available vehicles to allow replacement of different vehicle bodies. In one embodiment, the vehicle body displayed may be a three-dimensional NASCAR model.

11 Claims, 4 Drawing Sheets

SOLAR POWERED DISPLAY

FIELD OF THE INVENTION

This invention relates, in general, to window ornamentation, and more particularly, to a solar powered window display of a racecar.

Ornaments have been mounted on the inside of an automobile or store window for amusement or advertising. These ornaments usually consist of components that are stationary, having fixed messages and displays. In order to change a message or display, an entirely new ornament must be purchased to replace the existing display.

An important object of the invention is to provide a realistic structural representation of a vehicle displaying movable parts, e.g. wheels, that also provides the ability to alter of the display to take into account changing preferences of the vehicle displayed.

SUMMARY OF THE INVENTION

The present invention is directed to a display of a vehicle body with at least one rotating wheel. The vehicle body may be removed and replaced with another vehicle body. The wheels are rotated by a drive mechanism principally powered by photovoltaic power cells.

Additional features and advantages are realized through the techniques of the invention. Other embodiments and aspects of the invention are described in detail herein and are considered a part of the claimed invention.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

BEST MODE FOR CARRYING OUT THE INVENTION

Generally stated, a novel window display powered by solar energy is presented. To summarize, the unique window display includes a vehicle body removablely attached to a frame securable to a window. The display also includes at least one wheel that rotates by means of a drive mechanism powered by light.

Although the display is discussed in detail as a window display, it is envisioned that the display may rest on a table top or other substantially flat surface with an appropriate supporting base for the frame. The supporting base (not shown) may be a block made out of wood, plastic or other suitable material adapted to support the frame.

Figure 1:
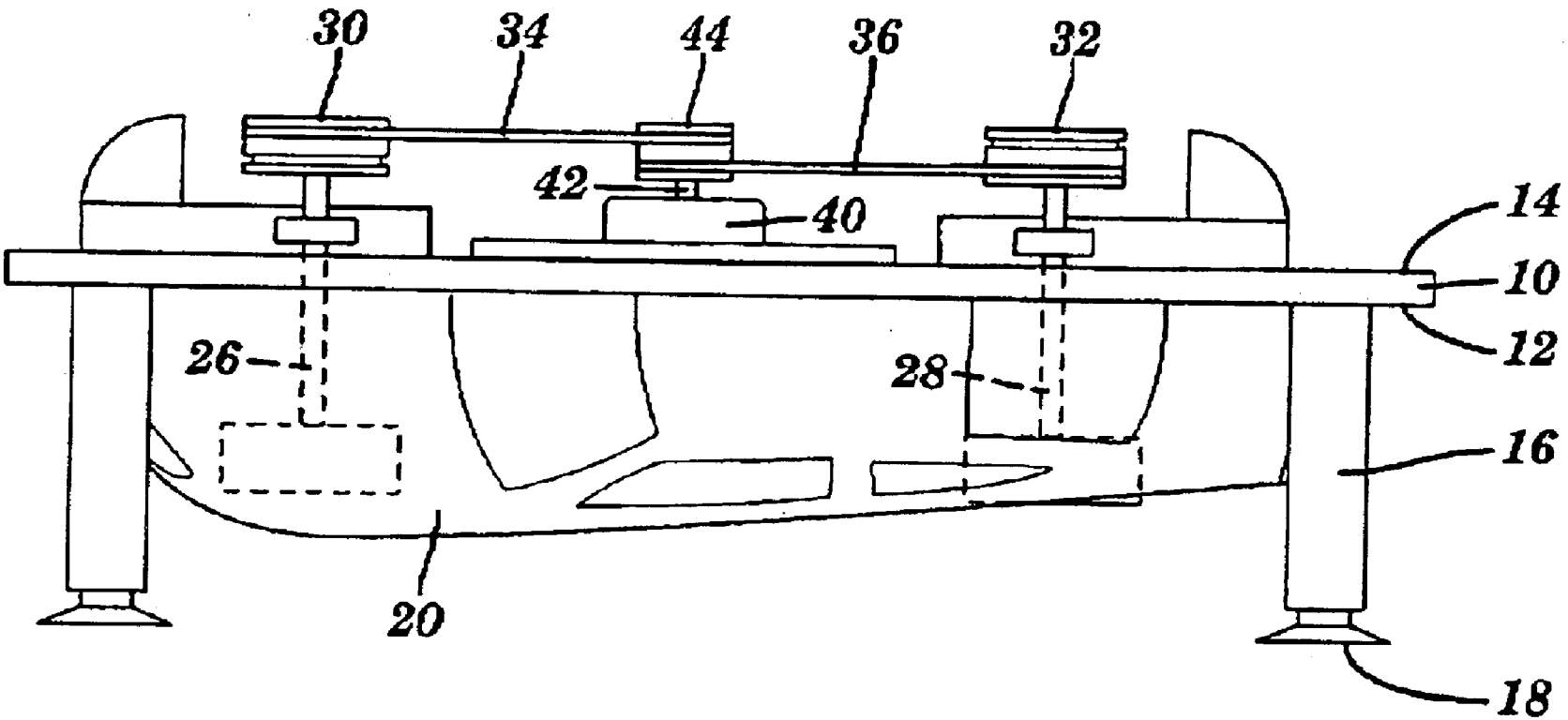
FIG. 1 is a top view of the window display illustrating the use of an automobile display.
Figure 2:
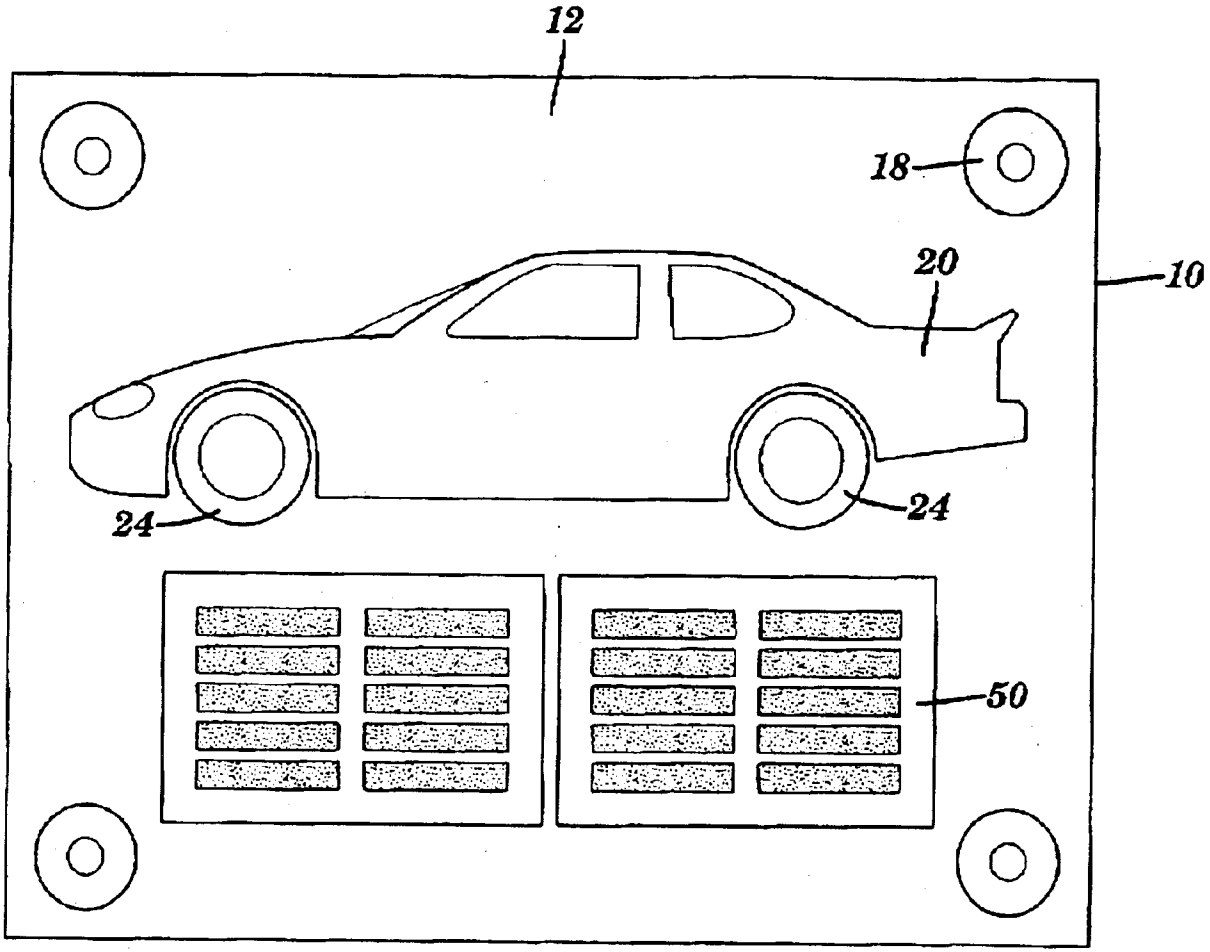
FIG. 2 is a front view of one embodiment of the window display.

FIGS. 1 and 2 depict one embodiment of a window display in accordance with the principles of the present invention. The window display may be constructed employing a rigid, generally planar frame 10 having a front panel 12 and a back panel 14 adapted to be disposed in an upright position. Front panel 12 has supported thereon a vehicle or a portion of a vehicle 20 having front and rear wheels 22, 24. In one embodiment, back panel 14 supports the drive mechanics within a casing (not shown) for operating certain components of the window display. In an alternate embodiment, the drive mechanism may be supported on the front panel and hidden from view by a casing or, alternatively, behind the vehicle body.

In one embodiment, vehicle 20 is a three-dimensional model. In an alternate embodiment, vehicle 20 is a two dimensional picture, such as, for example, a sticker, decal or drawing of a vehicle. Vehicle 20 may, for example, depict a NASCAR, Busch series truck or Indy car having thereon decals representing specific drivers or advertisement sponsors resembling scaled down models of actual race cars on, e.g., the NASCAR circuit. Although, other vehicles, such as, for example, sports cars, classic cars, motorcycles, bicycles, airplanes and the like, and other themes may be depicted.

Figure 4:
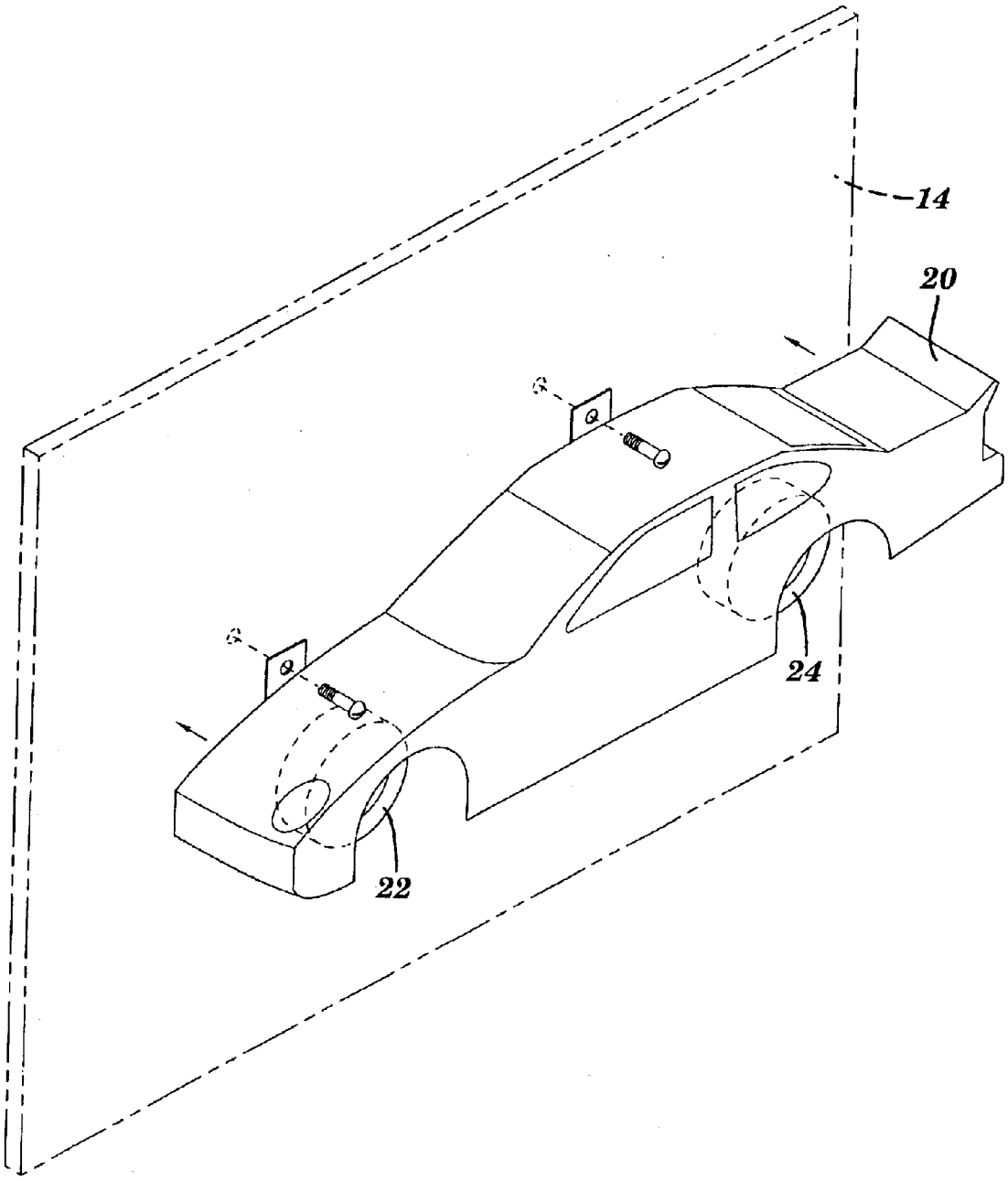
FIG. 4 is a front perspective view of one embodiment of the window display illustrating the removable feature of the vehicle body.

Vehicle 20 is removably attached to front panel 12 of frame 10 and therefore may be selected from a plurality of possible vehicles representing different vehicles and themes. For two-dimensional pictures or decals, an adhesive, Velcro or the like may removably attach vehicle 20. For three-dimensional models, vehicle 20 may rest on a bottom frame supporting wheel axles 26, 28. Alternatively, vehicle body 20 may attach by accessible and removable screws (as shown in FIG. 4), Velcro, straps and snaps, press-fit or other fastening means to front panel 12 of frame 10. Alternatively, thumb tabs or hooks may be incorporated into the vehicle bodies and adapted to fit into slots in front panel 12 or frame 10 and lock into place. In yet another embodiment, vehicle 20 could have tabs that slide into a groove or slot formed in frame 10 and lock into place. This would enable the vehicle bodies to be changed by pushing on the tabs and popping the bodies off. The use of male and female connectors that snap or click together may also be used to removably attach vehicle 20 to frame 10. By removably attaching the vehicle to front panel 12, the vehicle displayed is interchangeable with other vehicle models or pictures. For example, in an embodiment in which the vehicle depicts a NASCAR theme, the user may interchange the NASCAR model displayed depending on which car won the last NASCAR race or on changes on preference of favorite drivers or Wheels 22, 24 may be disks or toy wheels, of any suitable material, mounted for rotation about respective front and rear axles 26, 28. In one embodiment, front and rear axles 26, 28 extend through frame 10 and are adapted to rotate by, for example, a bearing surface within an opening formed in frame 10. The bearing surface should permit rotary motion of axles 26, 28 while resisting any radial motion that would cause the wheels to rotate eccentrically. In one embodiment, a bottom frame that supports the axles of the three-dimensional model may be used and inserted through the frame. In this embodiment, models that fit this particular bottom frame may be displayed by cutting the vehicle body down the middle from front to back and attaching the same to frame 10.

Figure 3:
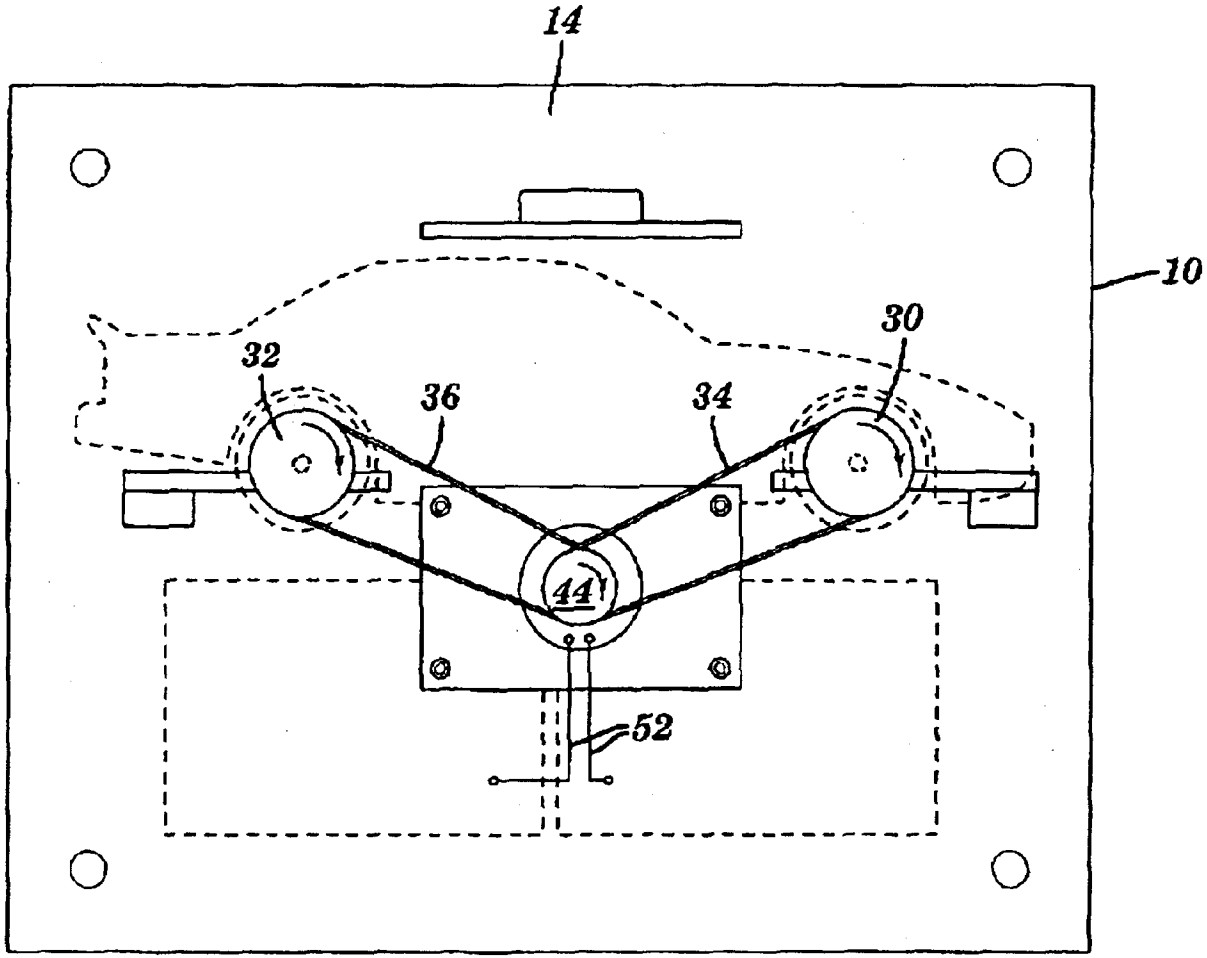
FIG. 3 is a back view of one embodiment of the window display illustrating the drive components of the display.

FIGS. 1 and 3 depict one embodiment of the drive mechanics on rear panel 14. Front and rear axles 26, 28 each have attached a pulley wheel 30, 32 for driving the axles. Each pulley wheel 30, 32 includes a single groove formed in the rim and adapted to receive a drive belt 34, 36. Drive belts 34, 36 may be a flexible friction band made from a compressible material such as silicone. A motor 40 drives wheel pulleys 30, 32 attached to each wheel axle. One suitable motor that may be used is a miniature DC motor that operates from 0.5 to 3 volts with no load and 15 mA/start-up 100 mA, which is sold as model MC-05/07 by Mabuchi Motor Co., Ltd. of Japan.

Motor 40 is mounted to frame 10 and operably connected to wheel pulleys 30, 32 by a drive wheel 44 attached to the motor drive shaft 42. Drive wheel 44 includes two grooves formed in the rim and adapted to receive drive belts 34, 36 connecting drive wheel 44 with wheel pulleys 30, 32. In an alternate embodiment, motor 40 includes two drive wheels coupled to drive shaft 42 for accommodating drive belts 34, 36 from each of the wheel pulleys.

In an alternate embodiment, drive shaft 42 of the motor 40 may be coupled directly to one of the rotating wheels. In this embodiment, there is no need for a pulley wheel and drive belt to drive the wheel directly attached to drive shaft 42 of motor 40. The other wheel may be driven by its own respective motor or, alternatively by a pulley wheel connected by a drive belt to a drive wheel coupled to the drive shaft of the motor directly attached to the other wheel.

In an embodiment in which the drive mechanics are supported by front panel 12, flanges that extend outwardly from front panel 12 may support the vehicle body, motor(s) and wheel axle such that the drive mechanism is positioned on front panel 12, e.g. behind vehicle body 20, rather than on rear panel 14.

Motor 40 is energized by DC current produced by at least one conventional photovoltaic power cell 50 in response to exposure to light. One suitable photovoltaic cell that may be used is a one-volt power panel with a 500 mA output in maximum sunlight sold under the name Solarts by Solar World of Colorado Springs, Colo. Photovoltaic cell 50 may be mounted to front panel 12. In one embodiment, the photovoltaic cell 50 is pivotably mounted to front panel 12 such that the cell may be adjusted and angled towards the light source. A layer of glass that is mounted against the power cell protects the power cell. A pair of leads 52 extends through the frame and connects with terminals of motor 40 in a conventional manner.

Although the main source of power for the display is a photovoltaic cell, other sources of electrical power may be used as backup or auxiliary power. For example, backup electrical power could be supplied from batteries mounted on the rear panel or from a conventional electrical outlet or a cigarette lighter adaptor plug wired to the display. The batteries may be recharged by the photovoltaic cell. An on/off switch may also be provided in series with the motor terminals to turn the display on and off.

Frame 10 is provided with a releasable fastening means for securing the window display to an interior vehicle window surface. In one embodiment, frame 10 includes at least one stanchion 16 that projects from front panel 12 of frame 10, with a suitable glass panel attachment means, comprised of, for example, suction cups 18 at a point just clear of the ornamentation on front panel 12. In alternate embodiments, other mounting means could include a suitable pressure adhesive, magnetics, hooks attachable to the upper portion of a window or Velcro-type patches. The mounting should provide a secure attachment such that a window (e.g. an automobile window) may be decorated in a very convenient and reliable manner while exposing the photovoltaic cells to sufficient light to power the motor.

The window display may also include other visual and audible features. For example, the vehicle may include headlights, brake lights, or interior lights in the form of LEDs connected by a wire lead to, for example, the photovoltaic cell, a battery, an electrical outlet, or the like. A pictorial scene or advertisement may be disposed on the other portions of the front panel, which may also be lighted. The display may also include a speaker for producing vehicle or other related noise such as, for example, the sound of a running automobile engine, a horn, the cheer of the crowd or the like.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A solar powered display comprising:

a frame having a front panel;

a vehicle body;

means for removably mounting the vehicle body to the front panel of said frame for interchanging with a second vehicle body;

at least one wheel mounted for rotation on said frame about an axle wherein the vehicle body is removably mounted without removing the at least one wheel from said frame;

an electrically operable motor drive for rotating said axle; and a photovoltaic power cell connected to the motor drive, said photovoltaic power cell supplying electrical power to said motor drive.

2. The solar powered display of claim 1, wherein said vehicle body is a three-dimensional model.

3. The solar powered display of claim 1 further comprising a battery back-up power source for the motor drive.

4. The solar powered displayed of claim 1, wherein said frame is adapted to secure to an interior window surface.

5. The solar powered display of claim 1 further comprising releasable fastening means for securing said frame to an interior window surface.

6. The solar powered display of claim 5, wherein said releasable fastening means comprises at least one stanchion extending from said frame and having a suction cup at an end for securing to the interior window surface.

7. The solar powered display of claim 1, wherein said ornament comprises two wheels mounted for rotation.

8. The solar powered display of claim 7, wherein each wheel includes a respective motor coupled to said wheel for rotating said wheel.

9. The solar powered display of claim 7, wherein said motor drive comprises one motor coupled to each of said wheels by a pulley and drive belt system.

10. The solar powered display of claim 1, further comprising a base for supporting said frame on a substantially flat surface.

11. An ornament comprising:

a frame having a front panel;

a vehicle body;

means for removably mounting the vehicle body to said frame for interchanging with a second vehicle body, at least one wheel mounted for rotation on said frame about an axle, wherein the vehicle body is removably mounted without removing the at least one wheel from said frame; and an electrically operable motor drive for rotating said axle.

* * * * *